US006927622B2

(12) United States Patent
Rashid et al.

(10) Patent No.: US 6,927,622 B2
(45) Date of Patent: Aug. 9, 2005

(54) CURRENT SOURCE

(75) Inventors: Tahir Rashid, Harrow (GB); Saul Darzy, Edgeware (GB)

(73) Assignee: STMicroelectronics Limited, Almondsbury Bristol (GB)

( * ) Notice: Subject to any disclaimer, the term of this patent is extended or adjusted under 35 U.S.C. 154(b) by 0 days.

(21) Appl. No.: 10/634,214

(22) Filed: Aug. 5, 2003

(65) Prior Publication Data

US 2004/0027191 A1 Feb. 12, 2004

(30) Foreign Application Priority Data

Aug. 6, 2002 (EP) ..... 02255483

(51) Int. Cl.[7] ..... G05F 3/26; G05F 3/22
(52) U.S. Cl. ..... 327/538; 327/513; 323/312
(58) Field of Search ..... 327/143, 198, 327/513, 538, 540; 323/312, 315, 901

(56) References Cited

U.S. PATENT DOCUMENTS 4,340,851 A * 7/1982 Nishikawa ..... 323/311
5,481,180 A 1/1996 Ryat
5,519,354 A 5/1996 Audy
5,900,773 A 5/1999 Susak
6,218,894 B1 4/2001 De Langen et al.
6,249,175 B1 * 6/2001 Ebana ..... 327/538
6,465,998 B2 * 10/2002 Sirito-Olivier ..... 323/315
6,677,808 B1 * 1/2004 Sean et al. ..... 327/539
6,724,176 B1 * 4/2004 Wong et al. ..... 323/316
6,724,244 B2 * 4/2004 Wu ..... 327/543
6,759,893 B2 * 7/2004 Gailhard et al. ..... 327/513

FOREIGN PATENT DOCUMENTS

EP 0 714 055 A1 5/1996

OTHER PUBLICATIONS

European Search Report from European Patent Application No. 02255483.6, filed Aug. 6, 2002.

* cited by examiner

*Primary Examiner*—Timothy P. Callahan
*Assistant Examiner*—Terry L. Englund
(74) *Attorney, Agent, or Firm*—Lisa K. Jorgenson; James H. Morris; Wolf, Greenfield & Sacks, P.C.

(57) ABSTRACT

A current source, adapted to generate a current proportional to absolute temperature has a greatly reduced supply voltage dependence and is still able to operate at low operating voltages. This is achieved by the incorporation of a compensation resistor through which a start-up current is passed.

7 Claims, 2 Drawing Sheets

CURRENT SOURCE

FIELD OF THE INVENTION

The present invention relates to a current source, and particularly, but not exclusively, to a current source adapted to generate a current proportional to absolute temperature (PTAT).

DISCUSSION OF THE RELATED ART

PTAT current sources are used widely as biased current generators in integrated circuits. A simple implementation of such a source is shown in FIG. 1. The circuit in FIG. 1 has first and second branches connected between supply Vdd and ground GND rails. The first branch comprises a resistor Re1, a first bipolar transistor Q1 with its base tied to its collector, a second bipolar transistor Q3 and a resistor R. The second branch includes a third resistor Re2, a third bipolar transistor Q2 with its base connected to the base of the bipolar transistor in the first branch, and a fourth bipolar transistor Q4 with its base connected to its collector and its base connected to its corresponding bipolar transistor in the first branch. Thus, the first and third transistors are connected in a current mirror configuration, as are the second and fourth transistors. An output transistor $Q_0$ has its base connected to the bases of the first and third transistors Q1, Q2 and its emitter connected via a resistor Re0 to the upper supply rail Vdd. The output current Iout is the collector current of the output transistor $Q_0$ which is supplied to the load driven by the current source. The emitter of the second bipolar transistor in the second branch is connected to the lower supply rail GND. In that circuit, assuming that the area of the bipolar transistor Q3 is n times the area of the bipolar transistor Q4, then it can be shown that the output current Iout is given by:

$$Iout = \frac{V_T \ln n}{R}$$

where $V_T$ is the thermal voltage (KT/q) and ln is the natural log. Hence the output current Iout is proportional to the thermal voltage $V_T$, which is proportional to absolute temperature T. One drawback of the circuit of FIG. 1 is that the value of the output current Iout increases with the supply voltage Vdd because of the early effect of the bipolar transistors. This variation of the output current with supply voltage can be reduced using various cascode configurations. However, a limitation of a cascode configuration is that it restricts the minimum operating voltage. In particular, with existing technologies it is not possible to use a cascoded PTAT current generator down to supply voltages as low as 1.2 V.

One example of a cascoded PTAT generator is shown in FIG. 2. In FIG. 2, the mirror connected bipolar transistors QC1 and QC2 form a cascode for transistors Q1 and Q2. Since the transistors Q1 and QC1 both have a voltage drop of around 0.6 V, it is clear that it is now not possible for the circuit to operate at 1.2 V. In fact, the minimum voltage is around 1.6 V. In FIG. 2, the output transistor $Q_0$ is not shown.

It is an aim of the present invention to provide a current source which can operate at lower supply voltages and in which the output current has a decreased dependence on temperature.

SUMMARY OF THE INVENTION

According to one aspect of the present invention there is provided a current source adapted to produce an output current comprising: first and second circuit branches connected between first and second reference voltages, the first branch including a branch resistor connected at a junction node to a compensation resistor which is connected to the second reference voltage; and a start-up circuit connected to generate a start-up current at the junction node whereby the voltage across the compensation resistor increases with the first reference voltage and acts to reduce changes in the output current with the first reference voltage.

Preferably each circuit branch comprises series-connected bipolar transistors. The first transistor in the first branch and the first transistor in the second branch are connected together in a current mirror configuration. Likewise, the second transistor in the first branch and the second transistor in the second branch are connected together in a current mirror configuration.

The circuit can comprise an output transistor whose base is connected to the bases of the first transistors, and the collector current of which provides the output current.

BRIEF DESCRIPTION OF THE DRAWINGS

For a better understanding of the present invention and to show how the same may be carried into effect, reference will now be made by way of example to the accompanying drawings, in which.

DETAILED DESCRIPTION

Figure 1:
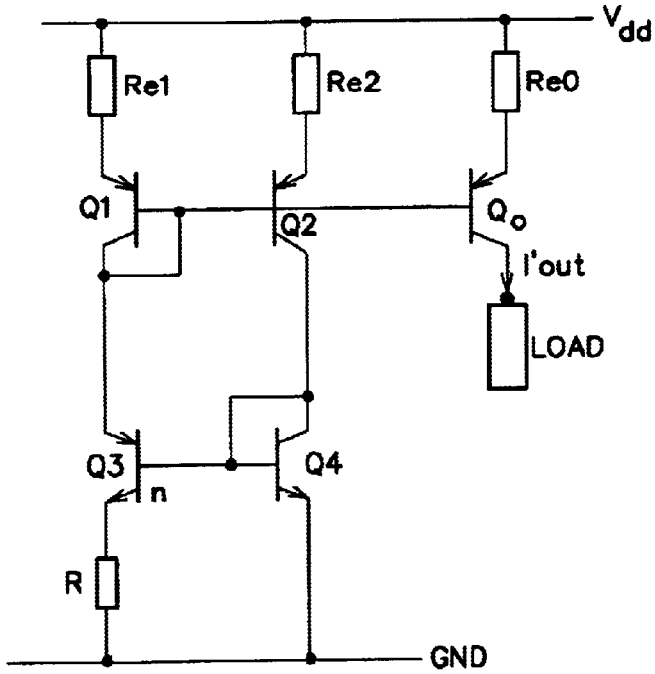
FIG. 1 (Prior Art)
FIG. 1 illustrates a simple implementation of a current source.
Figure 2:
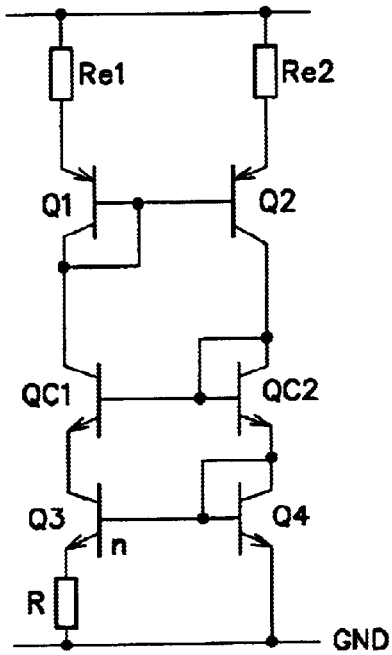
FIG. 2 (Prior Art)
FIG. 2 illustrates a cascoded version of the circuit of FIG. 1.
Figure 3:
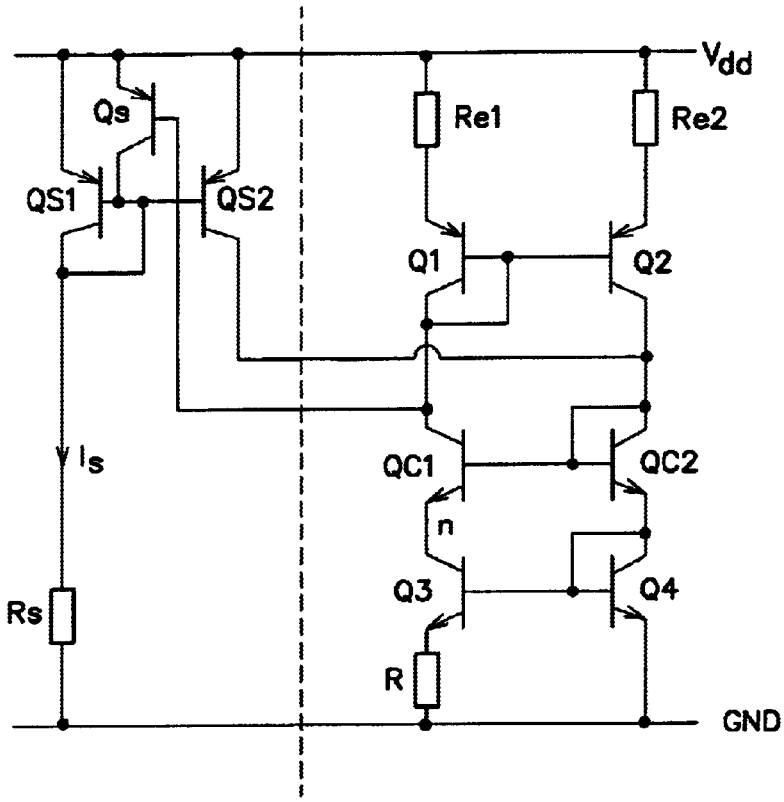
FIG. 3 illustrates the circuit of FIG. 2 with associated start-up circuitry.

FIG. 3 illustrates a cascoded current source circuit with start-up circuitry. The current source circuit itself is as illustrated in FIG. 2 and described above. In addition, FIG. 3 illustrates start-up circuitry in the form of mirrored bipolar transistors QS1 and QS2 and a switch transistor Qs. The mirror transistor QS1 has its emitter connected to the upper supply rail Vdd, and its collector connected through a start-up resistor Rs to ground GND and also to its base. The base of the first mirror transistor QS1 is connected to the base of the second mirror transistor QS2 which has its emitter connected to the upper supply rail Vdd and its collector connected to the collector of the transistor Q2 in the second branch of the current source. The switch transistor Qs has its emitter connected to the upper supply rail Vdd, its collector connected to the tied bases of the mirror transistors QS1, QS2 and its own base connected to the collector of the transistor Q1 in the first branch. A start-up current $I_s$ is created by the first mirror transistor QS1 and the resistor Rs. It is mirrored into the second mirror transistor QS2 and thus injected into the current source circuit at the collector of the transistor Q2. Once that circuit has started, the start-up current which was injected into the collector of the transistor Q2 is mirrored into the collector of the transistor Q1 and thus drives the base of the switch transistor Qs to turn off the start-up circuit. Note that the output transistor $Q_0$ is not shown in FIG. 3.

Figure 4:
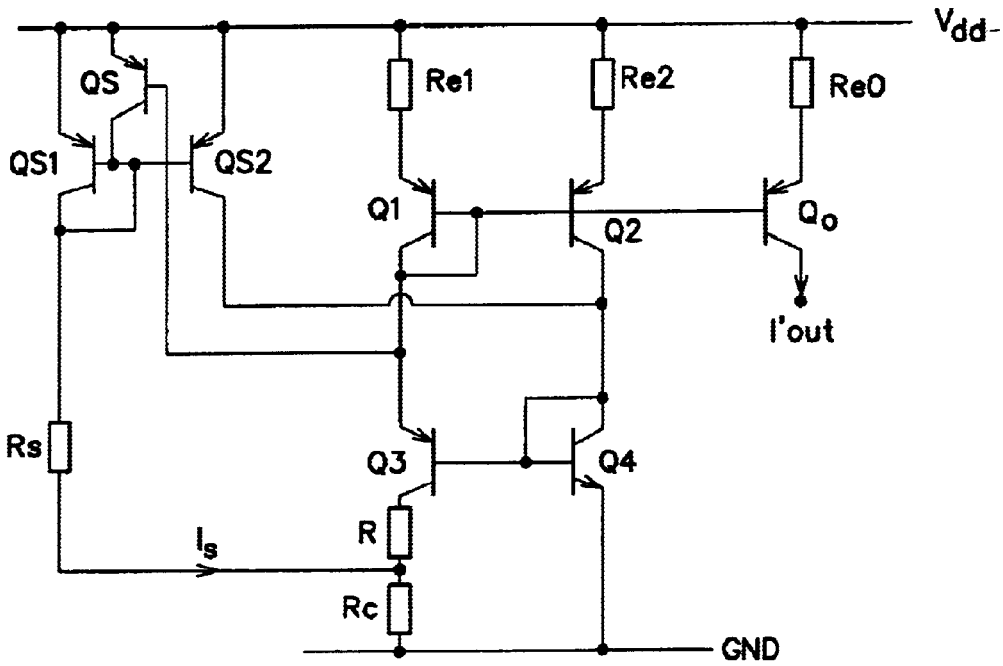
FIG. 4 illustrates a circuit in accordance with an embodiment of the invention.

As already explained above, the current source circuit illustrated in FIG. 3 cannot operate much below a supply voltage Vdd about 1.6 V. An alternative circuit configuration which can operate at lower supply voltages is illustrated in FIG. 4. In FIG. 4, like numerals designate like components as in the preceding figures. The circuit of FIG. 4 differs from that of FIG. 3 in that there is no cascode stage and in that there is an additional compensation resistor Rc connected between the branch resistor R and the lower supply rail GND. In addition, the start-up resistor Rs is connected between the start-up transistor QS1 and a connection node 8 between the branch resistor R and the compensation resistor Rc. This has the effect that a compensation current Ic flows in the compensation resistor Rc, generating a voltage Vc across the compensation resistor Rc. This actively created voltage reduces the base-emitter voltage of the third transistor Q3. This has the effect of reducing the collector current at Q3, which affects the magnitude of the output current Iout. In effect, the actively created voltage across the resistor Rc serves to feed back to the voltage at the emitter of the third transistor Q3, reducing it by a value which is determinable by the value of the compensation current Ic and the value of the compensation resistor Rc.

This has the effect that the output current I'out of the current source circuit of FIG. 4 is given by:

$$I'out = \frac{(V_T \ln n) - V_c}{R}$$

Note that the current $I_s$ continues to flow after start-up.

This alters the relationship between the output current Iout and the supply voltage Vdd. In the circuit of FIG. 3, when the supply voltage increases, the output current Iout also increases. However, in the circuit of FIG. 4, as the supply voltage Vdd increases, the current through the start-up resistor Rs will increase and so the current through the compensation resistor Rc will increase. As this happens, the voltage Vc taken across the compensation resistor Rc increases, thus reducing the emitter voltage of Q3 and thus the output current. By selecting the appropriate values for the branch resistor R and the compensation resistor Rc, the change in output current with supply voltage can be significantly reduced. It has been found that by appropriately selecting resistor values for resistors Re1 and Re2, in conjunction with appropriately selected resistor values R and Rc, the variation in output current with supply voltage can be reduced to less than 2% with a variation in supply voltage Vdd between 1 V and 10 V. This compares very favourably with a 47% increase in the output current Iout without the described compensation technique.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A current source adapted to produce an output current comprising:

first and second circuit branches connected in a current mirror type configuration between first and second reference voltages to generate branch currents, the first circuit branch comprising first and second bipolar transistors, the base of the first transistor being connected to its collector, and a branch resistor connected at a junction node to a compensation resistor which is connected to the second reference voltage; and a start-up circuit connected to generate a start-up current at the junction node which continues to flow after start-up whereby a voltage across the compensation resistor increases with the first reference voltage and acts to reduce changes in the output current with variations of the first reference voltage.

2. A current source according to claim 1, wherein the start-up circuit comprises a pair of start-up transistors connected in another current mirror configuration and a start-up resistor connected between a collector of one of said start-up transistors and said junction node.

3. A current source according to claim 1, wherein the second circuit branch comprises third and fourth series-connected bipolar transistors, the third bipolar transistor being connected as a first current mirror with the first bipolar transistor and the fourth bipolar transistor being connected as another current mirror with the second bipolar transistor.

4. A current source according to claim 1, which comprises an output transistor having its base connected to the base of the first transistor, the collector current of the output transistor constituting the output current.

5. A current source according to claim 1, wherein the branch resistor is connected between the junction node and the emitter of the second transistor.

6. A current source according to claim 3, wherein the area of the second transistor is larger than the area of the fourth transistor.

7. A current source adapted to produce an output current comprising:

first and second circuit branches connected in a current mirror type configuration between first and second reference voltages to generate branch currents, the first circuit branch including a branch resistor connected at a junction node to a compensation resistor which is connected to the second reference voltage; and a start-up circuit comprising a pair of start-up transistors connected in another current mirror configuration and a start-up resistor connected between a current path through one of said start-up transistors and said junction node, said start-up circuit being operable to generate a start-up current at the junction node which continues to flow after start-up whereby a voltage across the compensation resistor increases with the first reference voltage and acts to reduce changes in the output current with variations of the first reference voltage.

* * * * *